US011268655B2

(12) United States Patent
Bollinger et al.

(10) Patent No.: US 11,268,655 B2
(45) Date of Patent: Mar. 8, 2022

(54) CRYOSPHERE

(71) Applicant: Cryoport, Inc., Irvine, CA (US)

(72) Inventors: Bret Bollinger, Yorba Linda, CA (US); Hovhannes Melikyan, Granada Hills, CA (US)

(73) Assignee: Cryoport, Inc., Irvine, CA (US)

( * ) Notice: Subject to any disclaimer, the term of this patent is extended or adjusted under 35 U.S.C. 154(b) by 299 days.

(21) Appl. No.: 15/865,589

(22) Filed: Jan. 9, 2018

(65) Prior Publication Data

US 2019/0211971 A1 Jul. 11, 2019

(51) Int. Cl.

| | |
|---|---|
| ***F17C 13/06*** | (2006.01) |
| ***F17C 13/00*** | (2006.01) |
| ***F17C 13/08*** | (2006.01) |

(52) U.S. Cl.

CPC ..... *F17C 13/006* (2013.01); *F17C 13/06* (2013.01); *F17C 13/086* (2013.01); *F17C 13/005* (2013.01); *F17C 2201/0128* (2013.01); *F17C 2203/0391* (2013.01); *F17C 2203/0629* (2013.01); *F17C 2205/0107* (2013.01); *F17C 2205/0311* (2013.01); *F17C 2221/014* (2013.01); *F17C 2223/0161* (2013.01);

(Continued)

(58) Field of Classification Search

CPC ..... F17C 13/006; F17C 13/086; F17C 13/06; F17C 2270/0509; F17C 2205/0107; F17C 2205/0311; F17C 2203/0391; F17C 2201/0128; F17C 2260/036; F17C 2270/01; F17C 2250/0491; F17C 2250/0439; F17C 2221/014; F17C 3/08; F17C 2203/0629; B65D 2303/00; B65G 39/025; B65G 39/06

USPC ..... 193/35

See application file for complete search history.

(56) References Cited

U.S. PATENT DOCUMENTS 1,507,370 A * 9/1924 Freeble ..... A24F 19/00 220/629
1,816,057 A * 7/1931 Sager ..... B43L 25/10 211/69.2

(Continued)

FOREIGN PATENT DOCUMENTS

CN 104930347 A 9/2015
CN 106005766 A 10/2016

(Continued)

OTHER PUBLICATIONS

USPTO; Non-Final Office Action dated Dec. 2, 2011 in U.S. Appl. No. 12/658,641.

(Continued)

*Primary Examiner* — Brian M King
(74) *Attorney, Agent, or Firm* — Snell & Wilmer L.L.P.

(57) ABSTRACT

Methods, apparatus, and device, for a cryogenic storage system that stores and/or transports a liquid or gas at a temperature below ambient temperature. The cryogenic storage system has an enclosure and a cavity. The cryogenic storage system has a dewar that is positioned within the cavity of the enclosure. The dewar has a payload area that is configured to hold a liquid below ambient temperature. The dewar is configured to hold a liquid below ambient temperature and passively stabilize in an upright position. The dewar is formed with an inner wall and an outer wall and has an opening that allows access to the payload area.

12 Claims, 10 Drawing Sheets

(52) U.S. Cl.
CPC *F17C 2250/034* (2013.01); *F17C 2250/0439* (2013.01); *F17C 2250/0491* (2013.01); *F17C 2260/036* (2013.01); *F17C 2270/01* (2013.01); *F17C 2270/0509* (2013.01)

(56) References Cited

U.S. PATENT DOCUMENTS 2,722,336 A 11/1955 Wexler et al.
3,108,706 A 10/1963 Matsch et al.
3,455,480 A * 7/1969 Mitchell ..... B65D 7/22 220/23.4
3,555,904 A * 1/1971 Lenker ..... G01F 23/246 73/313
3,713,560 A * 1/1973 Slysh ..... F17C 13/086 137/343
3,717,005 A 2/1973 McGrew et al.
3,948,409 A 4/1976 Ovchinnikov et al.
4,140,073 A 2/1979 Androulakis
4,306,425 A 12/1981 Sitte et al.
4,365,576 A * 12/1982 Cook ..... B63B 35/44 114/257
4,411,138 A * 10/1983 Leithauser ..... F17C 13/06 62/48.1
4,455,842 A 6/1984 Granlund
4,694,655 A 9/1987 Seidel et al.
4,729,494 A 3/1988 Peillon et al.
4,790,141 A 12/1988 Glascock
4,919,300 A 4/1990 Anderson et al.
5,219,058 A * 6/1993 Sundseth ..... B65G 39/025 16/26
5,619,857 A * 4/1997 Caldwell ..... A62B 7/06 62/259.3
6,186,356 B1 * 2/2001 Berkley ..... F17C 1/00 220/304
6,467,642 B2 10/2002 Mullens et al.
6,490,880 B1 12/2002 Walsh
6,539,360 B1 3/2003 Kadaba
6,673,594 B1 1/2004 Owen et al.
7,627,926 B2 12/2009 Williams
7,881,987 B1 2/2011 Hart
8,220,107 B2 7/2012 Williams
8,387,818 B2 3/2013 Cognard
8,397,343 B2 3/2013 Williams
9,139,351 B2 * 9/2015 Chou ..... A61J 1/00
9,292,824 B1 3/2016 Freeman
9,378,442 B2 6/2016 Barnings
2002/0083718 A1 * 7/2002 Emmel ..... F17C 3/08 62/46.1
2002/0084277 A1 7/2002 Mullens et al.
2002/0099567 A1 7/2002 Joao
2002/0102992 A1 8/2002 Koorapaty
2002/0113070 A1 8/2002 Emmel
2002/0166326 A1 11/2002 Giesy et al.
2002/0167500 A1 11/2002 Gelbman
2003/0137968 A1 7/2003 Lareau et al.
2004/0215532 A1 10/2004 Boman
2004/0236635 A1 11/2004 Publicover
2005/0046584 A1 3/2005 Breed
2005/0171738 A1 8/2005 Kadaba
2005/0234785 A1 10/2005 Burman
2005/0246192 A1 11/2005 Jauffred et al.
2006/0080819 A1 4/2006 McAllister
2006/0121437 A1 6/2006 Poo et al.
2006/0168644 A1 7/2006 Richter et al.
2007/0009119 A1 1/2007 Pohle et al.
2007/0028642 A1 2/2007 Glade et al.
2007/0209376 A1 * 9/2007 Boer ..... F25D 21/006 62/155
2007/0268138 A1 11/2007 Chung et al.
2008/0094209 A1 4/2008 Braun
2008/0162304 A1 7/2008 Ourega
2008/0291033 A1 11/2008 Aghassipour
2009/0014537 A1 1/2009 Gelbman
2009/0293524 A1 12/2009 Vezina et al.
2009/0314835 A1 12/2009 Jackson
2010/0080168 A1 4/2010 Fukuyama
2010/0299278 A1 11/2010 Kriss et al.
2011/0140850 A1 * 6/2011 Wassel ..... F17C 13/021 340/8.1
2011/0155745 A1 6/2011 Chou et al.
2011/0216178 A1 9/2011 Carpenter
2011/0281352 A1 11/2011 Raeder et al.
2013/0014517 A1 1/2013 Diederichs et al.
2015/0257558 A1 * 9/2015 May ..... A47G 19/2272 220/669
2016/0003270 A1 * 1/2016 Franklin ..... F16B 1/00 439/529
2016/0078987 A1 * 3/2016 Simpkins ..... F25D 19/006 505/163
2016/0153665 A1 * 6/2016 Adeleye ..... F24C 3/14 431/344

FOREIGN PATENT DOCUMENTS

DE 102015205969 A1 10/2016
EP 3620233 A1 3/2020
FR 585827 A 3/1925
GB 2494651 A 3/2013
JP 09-329297 12/1997
JP 3958213 5/2018
NL 1033089 C2 6/2008
SU 1321986 A1 7/1987
WO 2002053967 11/2002
WO 2011/147384 12/2011
WO 2016/086143 A1 6/2016
WO WO 2020049123 A1 3/2020

OTHER PUBLICATIONS

USPTO; Final Office Action dated Aug. 14, 2012 in U.S. Appl. No. 12/658,641.
USPTO; Non-Final Office Action dated Sep. 11, 2015 in U.S. Appl. No. 12/658,641.
USPTO; Non-Final Office Action dated Dec. 11, 2012 in U.S. Appl. No. 12/852,413.
USPTO; Final Office Action dated May 10, 2012 in U.S. Appl. No. 12/852,413.
USPTO; Advisory Action dated Jul. 31, 2012 in U.S. Appl. No. 12/852,413.
USPTO; Non-Final Office Action dated Jun. 18, 2014 in U.S. Appl. No. 12/852,413.
USPTO; Non-Final Office Action dated June 17, 2016 in U.S. Appl. No. 12/852,413.
USPTO; Final Office Action dated Nov. 29, 2016 in U.S. Appl. No. 12/852,413.
USPTO; Non-Final Office Action dated Jul. 25, 2017 in U.S. Appl. No. 14/589,768.
USPTO; Final Office Action dated Feb. 7, 2018 in U.S. Appl. No. 14/589,768.
USPTO; Non-Final Office Action dated Jun. 19, 2018 in U.S. Appl. No. 14/589,768.
USPTO; Final Office Action dated Dec. 27, 2018 in U.S. Appl. No. 14/589,768.
PCT; International Search Report dated May 31, 2002 in International Application No. PCT/US2001/049684.
PCT; International Search Report dated Jun. 28, 2010 in International Application No. PCT/US2010/023252.
PCT; Written Opinion of International Search Authority dated Jun. 28, 2010 in International Application No. PCT/US2010/023252.
PCT; International Preliminary Report on Patentability dated Mar. 22, 2013 in International Application No. PCT/US2010/023252.
Electronic Reusable Paper, http://www2.parc.com/hsl/projects/gyricon/, (Oct. 2005).
PCT: International Search Report & Written Opinion dated May 8, 2019 in PCT Application No. PCT/US2019/012553.
Screenshot (1 pg.) of YouTube Video entitled "Upright Positioner"; WAK Chemie Medical GmbH Germany, published on Dec. 16, 2011; retrieved on Mar. 31, 2020 from URL: https://www.youtube.com/watch?v=LJeUh_pn2Mo.

(56) References Cited

OTHER PUBLICATIONS

PCT: Preliminary Report on Patentability dated Jul. 23, 2020 in PCT Application No. PCT/US2019/012553.
SG; Search Report & Written Opinion dated Oct. 28, 2021 in Application Serial No. SG11202006224Y.
EP; Supplemental Search Report dated Aug. 21, 2021 in Application Serial No. EP19738000.9.
PCT; International Search Report & Written Opinion dated Mar. 23, 2021 in PCT Application No. PCT/US2020/063823.
CN; Notice of First Office Action dated Oct. 25, 2021 in Chinese Application No. 201980011145.2.
USPTO; Restriction Requirement dated Jan. 20, 2022 in U.S. Appl. No. 16/730,506.

* cited by examiner

CRYOSPHERE

BACKGROUND

1. Field

This specification relates to a system, device or apparatus for cryogenically storing, transporting and/or shipping a liquid or gas below ambient temperatures.

2. Description of the Related Art

Lab technicians, scientists, medical professionals, such as doctors or nurses, and other technicians may cryogenically store and transport liquids or gases to various facilities, such as hospitals, labs and/or research facilities. When transporting the liquids or gases at cryogenic temperatures, the technicians and/or professionals store the liquid or gas in a dewar, which is used to hold the liquid or gas at a refrigerated or cryogenic temperature. The dewar may take several different forms including open buckets, flasks and/or self-pressurizing tanks. The dewar may be a double-walled metal or glass flask that has a vacuum between the walls. This provides thermal insulation between the walls.

The technician or professional may fill the dewar with the liquid or gas and package the dewar using shipping material. Then, the technician or professional provides the package including the dewar to a shipper to transport the contents to the final destination where it is unpacked. The liquid or gas, however, slowly boils so the dewar may have an opening on top, which is designed to allow the gas to escape. In addition, while being shipped, the dewar may be tilted or overturned resulting in the liquid or gas flowing out of the dewar.

Accordingly, there is a need for a system, device or apparatus to protect the liquid or gas in the dewar from evaporation and from pouring out while being transported.

SUMMARY

In general, one aspect of the subject matter described in this specification is embodied in a cryogenic storage system. The cryogenic storage system ("storage system") stores and/or transports a liquid or a gas. The storage system has an enclosure and a cavity. The storage system has a dewar that is positioned within the cavity of the enclosure. The dewar has a payload area that is configured to hold a liquid below ambient temperature. The dewar is configured to hold a liquid below ambient temperature and passively stabilize in an upright position. The dewar is formed with an inner wall and an outer wall and has an opening that allows access to the payload area.

These and other embodiments may optionally include one or more of the following features. The dewar may be shaped as a sphere and may have a center of mass or gravity within a bottom portion of the dewar, which passively stabilizes the dewar when the dewar is tilted, angled or rotated within the enclosure. The dewar may be a double-walled flask. The dewar may be a spherical dewar. The spherical dewar may be configured to return to the upright position within the enclosure when the enclosure is rotated or angled. The spherical dewar may have a bottom portion and a top portion. The bottom portion may weigh more than the top portion such that the spherical dewar remains upright or stabilizes when tilted or rotated. The enclosure may be shaped as a cube and may have multiple sides. The enclosure may have a circular opening on each side to provide access to the dewar when the dewar is placed inside the enclosure.

The storage system may have a removable vapor plug. The removable vapor plug may be configured to be inserted into the opening of the dewar to limit access to the cavity of the dewar. The removable vapor plug may have a handle portion and a neck. The storage system may have a temperature monitoring device. The temperature monitoring device may be configured to monitor temperature within the dewar and may be positioned within the neck. The temperature monitoring device may be configured to wirelessly connect with an electronic device and may transmit a temperature within the dewar to the electronic device.

The storage system may have a ball transfer device. The ball transfer device may be connected to and interface between the dewar and the enclosure. The ball transfer device may be configured to minimize friction between the dewar and the enclosure.

In another aspect, the subject matter is embodied in an enclosure for a dewar. The enclosure has a cavity that is configured to receive and enclose the dewar. The enclosure has multiple sides. Each side has an opening that allows access to the dewar when the dewar is inserted into the enclosure. The enclosure has a ball transfer device. The ball transfer device connects to the dewar and is configured to minimize friction between the dewar and the enclosure.

BRIEF DESCRIPTION OF THE DRAWINGS

Other systems, methods, features, and advantages of the present invention will be apparent to one skilled in the art upon examination of the following figures and detailed description. Component parts shown in the drawings are not necessarily to scale, and may be exaggerated to better illustrate the important features of the present invention.

DETAILED DESCRIPTION

Disclosed herein are systems, apparatuses and devices for transporting and storing a liquid or gas, such as liquid nitrogen. The system, apparatus or device may be a cryogenic storage system that stores and transports liquid. Particular embodiments of the subject matter described in this specification may be implemented to realize one or more of the following advantages.

The cryogenic storage system may have an enclosure that is made from a polymeric material so that the enclosure is able to withstand cryogenic temperatures. That is, the polymeric material is resistant to brittleness and not as susceptible to shattering at cryogenic temperatures. The enclosure may hold or suspend a dewar that contains the liquid or gas. Moreover, the enclosure surrounds the dewar to protect the dewar from any impacts. The enclosure may freely suspend or hold the dewar, such that the dewar freely rotates and/or moves about within the enclosure without impacting the inner sides of the enclosure. Moreover, the dewar may be spherical and have passive stabilization. That is, the dewar may have a center of mass that is located directly opposite from the opening and a center of gravity that is at or near the bottom of the dewar near the center of mass so that the dewar remains in or returns to an upright or vertical position when tilted. By being able to freely rotate within the enclosure and by having passive stabilization, the dewar remains upright regardless of the orientation of the enclosure to prevent spillage. Moreover, by stabilizing the dewar upright, the cryogenic storage system reduces the amount of evaporation of the liquid within the dewar. For example, the cryogenic storage system reduces the nitrogen evaporation rate within the dewar, which extends the life of the dewar in a shipment.

Other benefits and advantages include that the enclosure has multiple faces that provide access to the dewar, which improves physical access to the opening of the dewar for inserting and/or removing the liquid or gas. Additionally, the dewar may have an electronic device that conveys and monitors the temperature inside the dewar and has a connection device that reduces the amount of friction between the enclosure and the dewar when the dewar freely rotates.

Figure 1:
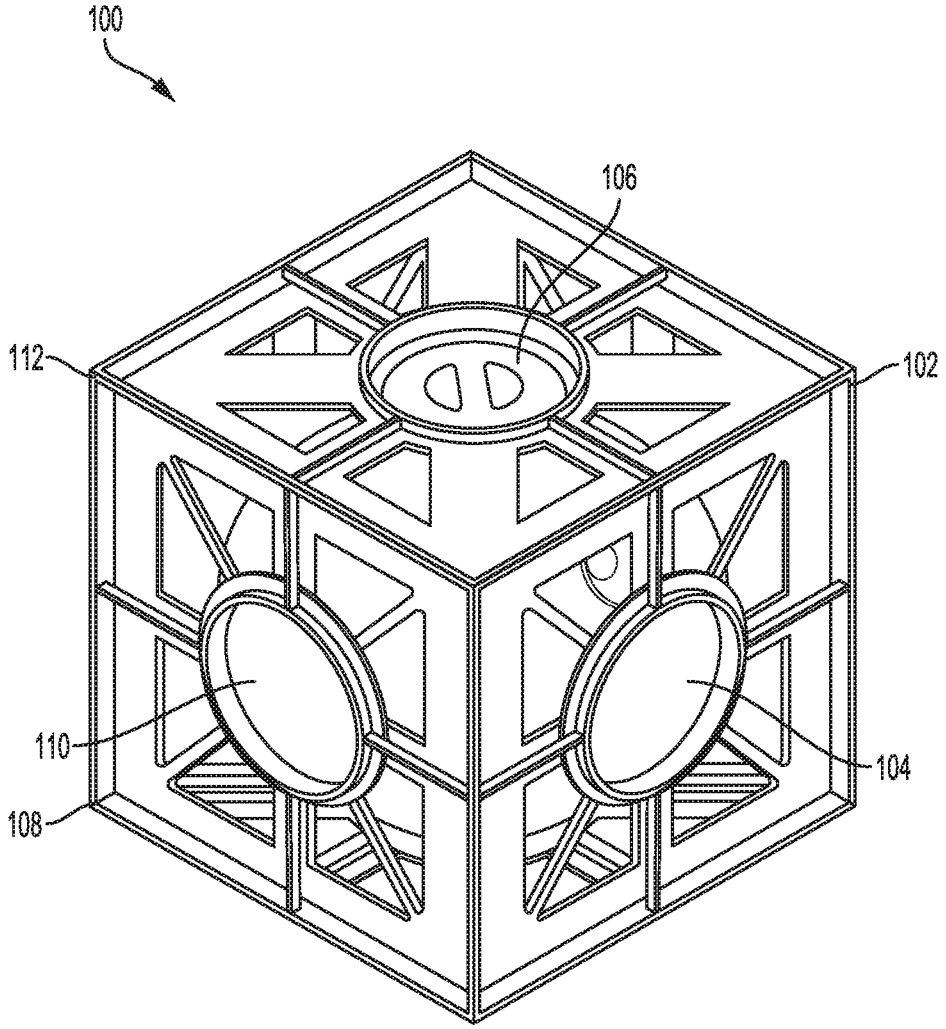
FIG. 1 shows an example cryogenic storage system according to an aspect of the invention.
Figure 2:
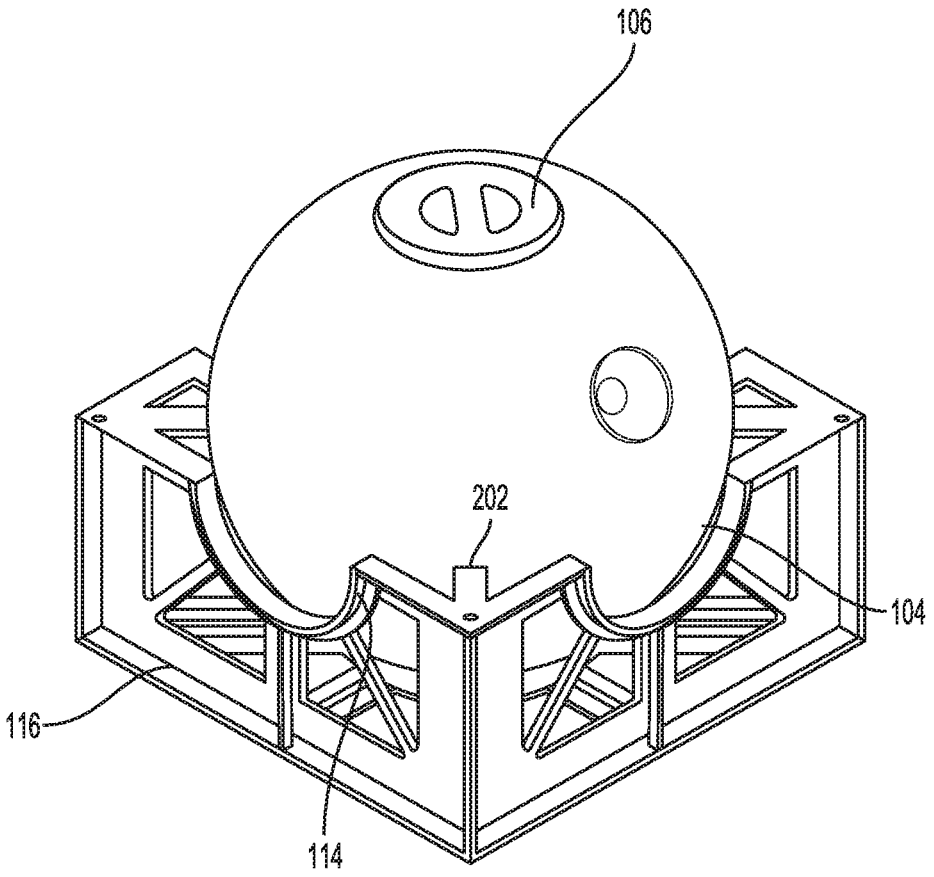
FIG. 2 shows a spherical dewar situated within the enclosure according to an aspect of the invention.

FIG. 1 shows a perspective view of the cryogenic storage system 100, and FIG. 2 shows a cross-sectional view of the cryogenic storage system 100. The cryogenic storage system ("storage system") 100 includes an enclosure 102, a dewar 104, such as a double-walled flask, and a vapor plug 106. The enclosure 102 is three-dimensional (3D) and may be shaped as a cube. The enclosure 102 may be shaped as any type of three-dimensional object, such as a cube, tetrahedron, dodecahedron or octahedron, and may be made from a polymeric material so that the enclosure 102 does not shatter at cryogenic temperatures.

The enclosure 102 has multiple sides 108 or faces. The sides 108 form a closed enclosure that surrounds or encloses the dewar 104. The sides 108 may be a planar or latticed surface that connects to the other sides to form the enclosure 102 and surround the dewar 104. The dewar 104 inserted into or placed into a cavity of the enclosure 102 so that the dewar 104 resides within the enclosure 102. The multiple sides 108 may snap together using one or more fasteners. The multiple sides 108 may snap together at one or more corners 112, for example. In some implementations, the enclosure may be formed from multiple modular pieces. The multiple modular pieces may be connected and/or fastened together to form the enclosure 102. The multiple sides may have one or more enclosure openings 110. The one or more enclosure openings 110 may be circular and/or shaped in the same shape as the dewar opening. The one or more enclosure openings 110 provide access to the dewar 104 as the dewar 104 rotates within the enclosure 102. Thus, the opening 402 of the dewar 104 may be access regardless of the orientation of the enclosure 102.

For example, the enclosure 102 is shaped as a cube and has 6 sides 108. Each side is connected to at least another side at a corner 112. On each side, there is an enclosure opening 110. The enclosure opening allows access to the vapor plug 106 and the dewar opening, when the dewar opening is aligned with the enclosure opening 110 on the side of the enclosure 102. Thus, as the dewar rotates within the cavity of the enclosure, the one or more enclosure openings 110 provide access to the vapor plug 106 and the dewar opening, when the one or more enclosure openings 110 align with the dewar opening.

The enclosure 102 may have an inner framework 114 and an outer framework 116. The outer framework 116 protects the dewar 104 from impacts, vibration and/or shocks. For example, the outer framework 116 separates the dewar 104 from other objects, such as other boxes or the side of a truck, when the enclosure 102 is shipped or stored. The inner framework 114 forms the cavity within the enclosure 102 where the dewar 104 is situated. The dewar may be suspended, placed or otherwise situated within the cavity of the inner framework 114 so that the dewar 104 is able to rotate within the cavity.

Figure 9:
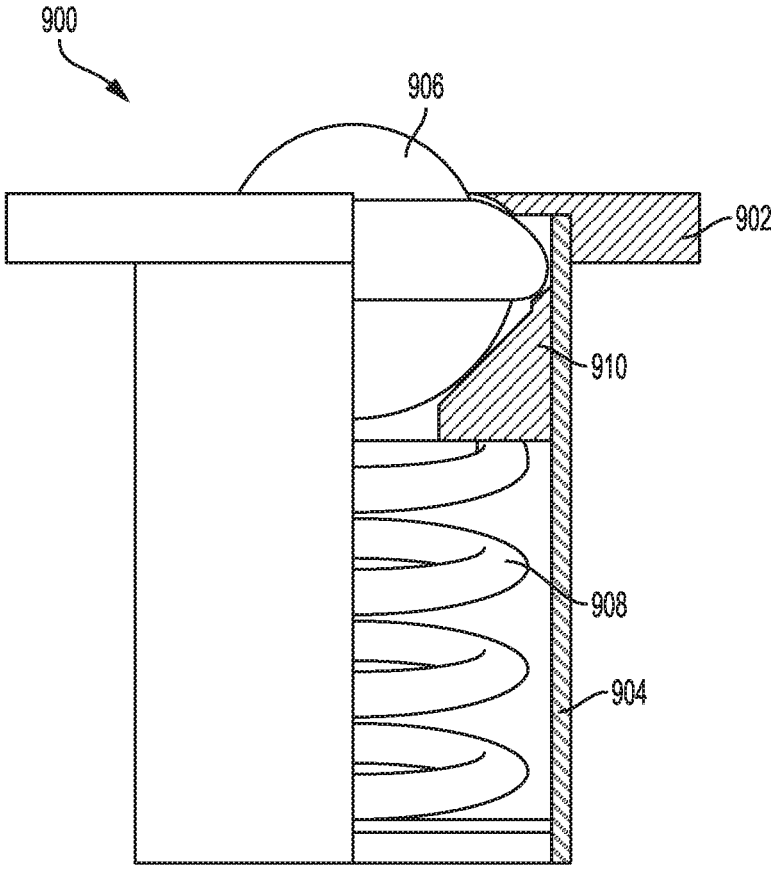
FIG. 9 is an example ball transfer device of the cryogenic storage system of FIG. 1 according to an aspect of the invention.

The storage system 100 may include a ball transfer device 900 that is connected between the enclosure 102 and the dewar 104. The ball transfer device 900 facilitates the movement of the dewar relative to the enclosure 102. The ball transfer device 900 may be positioned at an inner phalange or wing 202 that is between the enclosure 102 and the dewar and provide for a frictionless or near-frictionless surface. The ball transfer device 900 minimizes or eliminates friction between the dewar and the enclosure 102, which allows the dewar to freely move or rotate within the enclosure 102. FIG. 9 further describes the structure of the ball transfer device 900.

Figure 3:
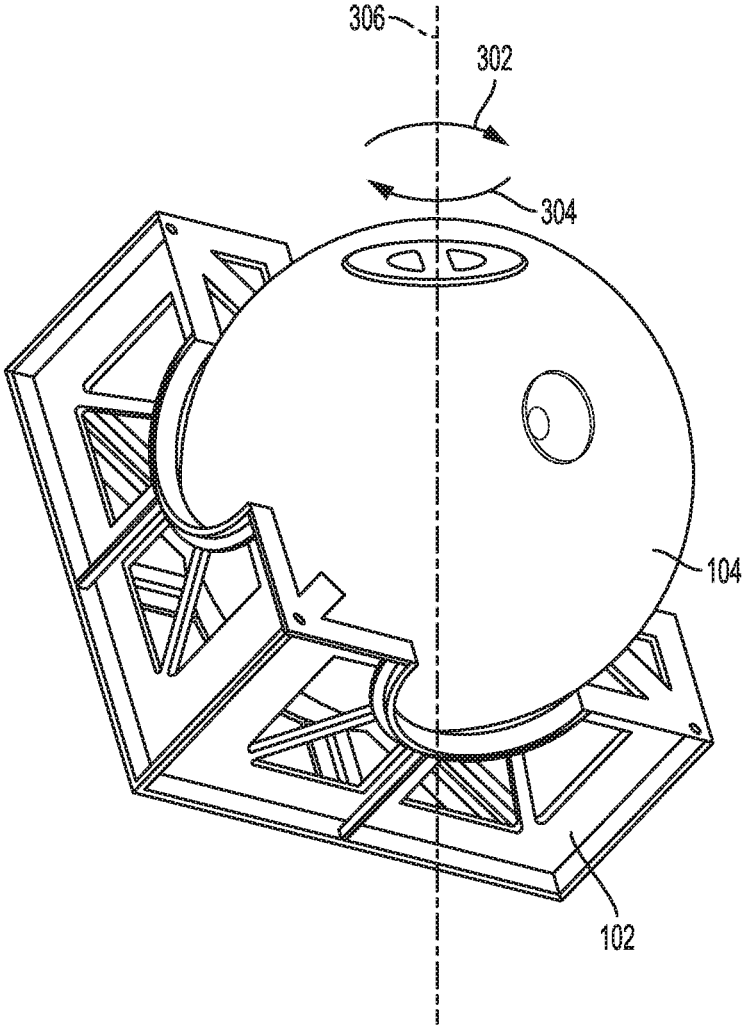
FIG. 3 shows the spherical dewar rotating within the enclosure according to an aspect of the invention.

The storage system 100 includes a dewar 104. The dewar 104 may be double-walled flask and may be shaped as a sphere or any other polyhedron. The dewar 104 may be situated centrally within a central cavity of the enclosure 102 and may freely rotate and/or move within the central cavity. The dewar 104 may rotate in the direction 302, 304 about a central vertical axis 306 or in any other direction three-dimensionally, as shown in FIG. 3 for example.

Figure 4:
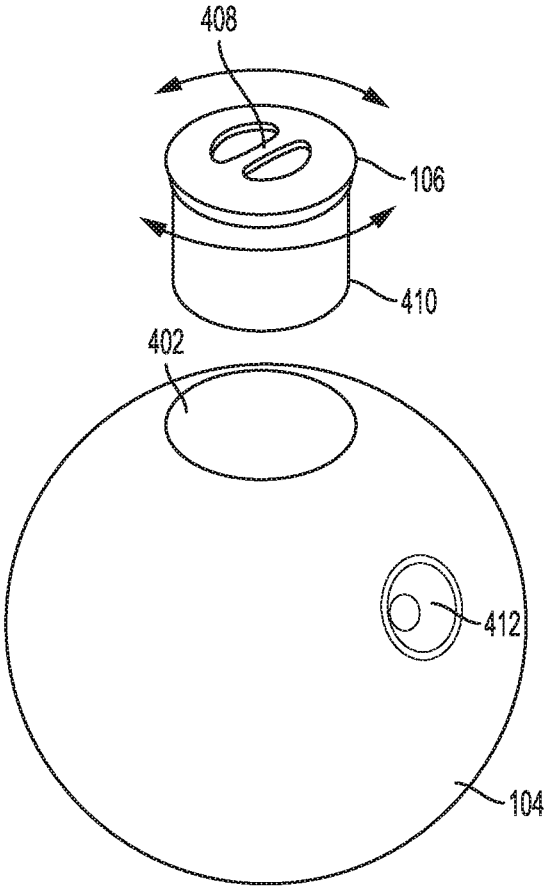
FIG. 4 shows an opened spherical dewar to allow the liquid or gas to be inserted according to an aspect of the invention.
Figure 5:
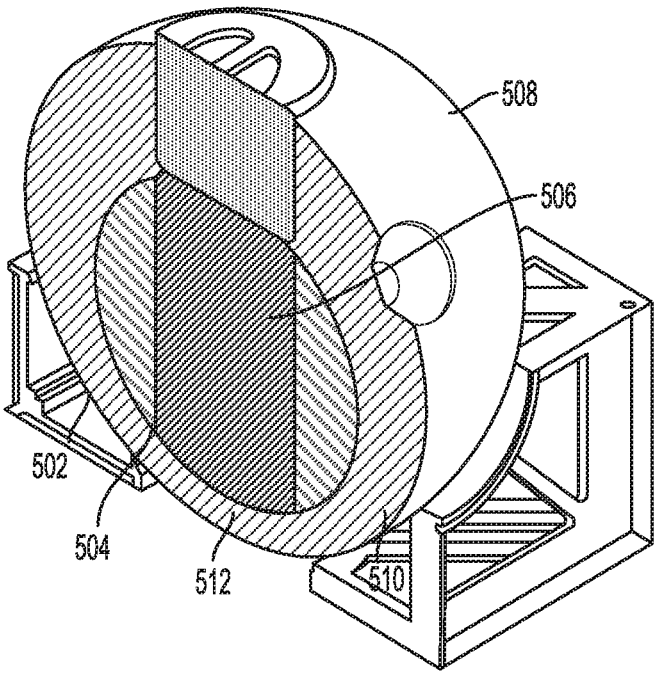
FIG. 5 shows a cross-sectional view of the cryogenic storage system of FIG. 1 according to an aspect of the invention.

The dewar 104 has an inner wall 504, an outer wall 502 and an opening 402. The storage system 100 may have a plug, such as the vapor plug 106, which may be inserted into the opening 402 to seal or partially seal the dewar 104 while allowing some gas to escape, as shown in FIG. 4 for example. The opening 402 leads to a cavity or payload area 506 that is within the dewar 104. FIG. 5 shows the payload area 506 in the cross-sectional view of the dewar 104. The dewar 104 may form a vacuum between the inner wall 504 and the outer wall 502 to hold or store a liquid or gas below ambient temperatures. The dewar 104 may have a pump-out port 412. The pump-out port 412 may be used to create a vacuum between the inner wall 504 and the outer wall 502 of the dewar 104, which allows the space in between the inner wall 504 and the outer wall 502 to be completely evacuated.

The dewar 104 has an inner wall 504 and an outer wall 502 with a vacuum between the inner wall 504 and the outer wall 502. The outer wall 502 has an opening 402 that allows a liquid or gas to be inserted or placed into the payload area 506. The opening 402 may be positioned opposite the center of gravity or mass 512 of the dewar 104, such that the opening 402 remains upright when the dewar 104 is passively stabilized. The opening 402 allows gases to escape from the payload area 506 of the dewar 104 to relieve the gas expansion within the dewar 104.

The inner wall 504 forms and/or encloses the payload area 506 within the dewar 104. The payload area 506 may be a cylindrical cavity within the dewar 104 that extends longitudinally from the top portion 508 through to the bottom portion 510 of the dewar 104. The payload area 506 holds or stores the liquid or gas below ambient temperatures. An absorbent material 606 may be at or surrounding a bottom portion of the payload area 506. The absorbent material 606 may maintain the temperature within the payload area 506 below the ambient temperature.

Figure 6A:
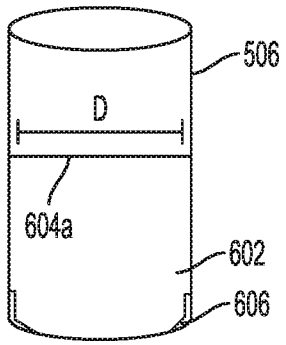
FIGS. 6A-6C show the liquid or gas within the payload area in different orientations according to an aspect of the invention.
Figure 6B:
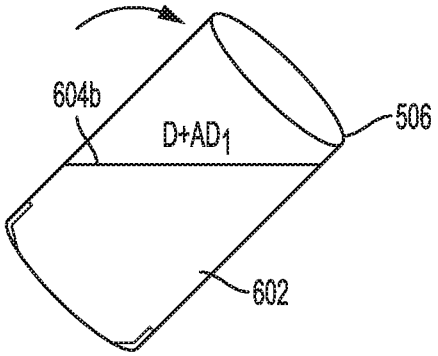
Figure 6C:
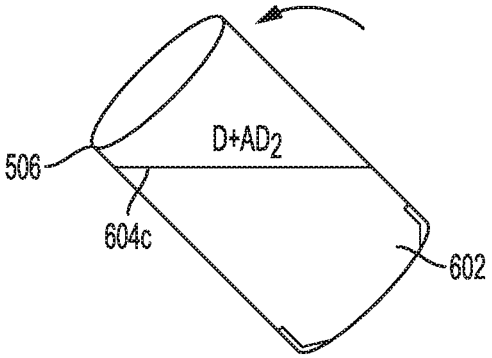

The dewar 104 has a top portion 508 and a bottom portion 510. The top portion 508 is where the opening 402 is located and remains upright due to passive stabilization of the dewar 104. The bottom portion 510 includes the center of gravity or mass 512. Since the center of gravity or mass 512 is located within the bottom portion 510 of the dewar 104, the dewar 104 stabilizes around the center of gravity or mass 512 so that the dewar 104 remains upright. By stabilizing the dewar 104 around the center of gravity or mass 512 regardless of the orientation of the enclosure 102, the storage system 100 reduces the amount and/or rate of evaporation of the liquid or gas and/or absorbent material, e.g., the nitrogen evaporation rate is reduced. The amount and/or rate of evaporation of the liquid or gas and/or absorbent material is based on the amount of the cross-sectional surface area 604*a-c* of the liquid or gas 602, as shown in FIGS. 6A-6C for example. Additionally, by having passive stabilization, the dewar 104 increases an amount of shipping density within a shipping container, as the dewar 104 may be enclosed in an enclosure 102 of any shape which allows the shipper to use any shape for the enclosure 102 that best fits the available space or empty volume within the shipping container.

FIG. 6A shows the liquid or gas 602 and the absorbent material 606 within the payload area 506 of the dewar 104 when the dewar 104 is upright. The absorbent material 606 may be positioned within or surrounding the bottom portion of the payload area 506 of the dewar 104. The cross-sectional surface area 604*a* of the liquid or gas 602 has a diameter, D, when the dewar 104 is upright because the payload area 506 is upright or vertical. If the payload area 506 were to be angled or tilted, as shown in FIGS. 6B and 6C for example, the liquid or gas 602 would have cross-sectional surface areas 604*b-c* of D+ΔD, respectively, that are greater than the cross-sectional surface area 602*a*, D, when the payload area 506 is upright or vertical. As the payload area 506 tilts or angles, the shape of the cross-sectional surface area 604*a* transitions from a circular shape due to the cylindrical nature of the payload area 506 to the elliptical shape of the cross-sectional surface areas 604*b-c*. The size of the elliptical cross-sectional surface areas 604*b-c* increase as the angle increases. The increased cross-sectional surface areas 602*b-c* result in an increased evaporation rate and/or amount of the liquid or gas 602 and/or an increased burn rate or amount of the absorbent material 606. The increased cross-sectional surface areas 604*b-c* expose more of the liquid or gas 602 to a higher temperature medium causing a faster burn rate for the absorbent material 606 to cool the liquid or gas 602. Moreover, the liquid and/or gas may spill out or escape from the opening 402 of the dewar 104 as the payload area 506 is tilted. Additionally, as liquid or gas 602 spills out and/or the cross-sectional surface area 602*b-c* increases, a partial vacuum is created, which draws in warm air that further increases the average temperature and causes a faster burn rate for the absorbent material 606 to cool the liquid or gas 602.

Since the dewar 104 within the storage system 100 has passive stabilization that maintains the dewar 104 in the upright position regardless of the orientation of the enclosure 102, the payload area 506 within the dewar 104 maintains the upright position or returns to the upright position when the dewar 104 is tilted, rotated and/or otherwise angled. Thus, the storage system 100 reduces the amount and/or rate of evaporation of the liquid or gas 602 and reduces the burn rate of the absorbent material 606 by maintaining the dewar 104 in the upright position and/or passively adjusting the dewar 104 so that the dewar 104 returns to or maintains the upright and/or vertical position. Moreover, by reducing the burn rate of the absorbent material 606, which may be nitrogen, the dynamic holding time of the dewar 104 increases. The dynamic holding time is the time that the dewar 104 maintains the internal temperature at or below −150° C. during transportation.

The storage system 100 includes a vapor plug 106. FIGS. 4, 7A and 7B show the vapor plug 106. The vapor plug 106 may have a handle portion 408 and a neck 410. The handle portion 408 may have a handle or grip that allows a user to twist the vapor plug 106 in a clockwise or counter clockwise direction to insert at least a portion of the neck 410 into the opening 402. The vapor plug 106 may be removable. That is, the vapor plug 106 may be inserted into the opening 402 of the dewar 104 to close or partially close the dewar 104 and prevent access to the payload area 506. The handle portion 408 and/or the neck 410 may be made from a non-conductive material, such as a polymer or fiberglass like material.

The vapor plug 106 may be turned or twisted clockwise and/or counter-clockwise, as shown in FIG. 4 for example. For example, the vapor plug 106 may be turned clockwise when inserted into the opening 402 to secure the vapor plug 106 within the opening 402 and turned counter-clockwise to remove the vapor plug 106 from the opening 402 to allow insertion of the liquid or gas into the payload area 506. In another example, the vapor plug 106 may be turned counter-clockwise when inserted into the opening 402 to secure the vapor plug 106 within the opening 402 and turned clockwise to remove the vapor plug 106 from the opening 402. The vapor plug 106 may be inserted into the opening 402 such that there remains a gap that allows gas to escape to prevent pressure from building up as the liquid within the payload area 506 evaporates.

Figure 7:
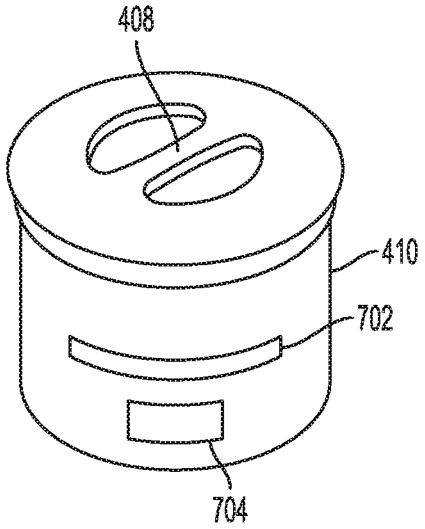
FIG. 7 is an example vapor plug of the cryogenic storage system of FIG. 1 according to an aspect of the invention.

The vapor plug 106 may have a locking device 704, as shown in FIG. 7. The locking device 704 may be positioned on the neck of the vapor plug 106. The locking device 704 may be one or more magnets that interlock with one or more other magnets within a top inner portion of the payload area 506 of the dewar 104. The magnets may have opposing polarities so that when vapor plug 106 is turned in certain position within dewar 104 the magnets lock vapor plug within the dewar 104. Conversely, when vapor plug 106 is rotated about its axis to another position, the opposing polarity of the magnets may force vapor plug out of dewar 104.

The locking device 704 locks when the vapor plug 106 is inserted within the payload area 506. Since there may be a gap between the vapor plug 106 and the inner portion of the payload area 506 of the dewar 104, the locking device 704 locks the vapor plug 106 in place with the dewar 104 to prevent the vapor plug 106 from falling out when the dewar 104 is oriented or rotated in different directions. The gap between the vapor plug 106 and the dewar 104 allows gas to escape due to the expansion of the gas or evaporation of the liquid within the payload area 506 to prevent pressure from building up within the payload area 506.

The storage system 100 may include an electronic thermocouple 702, which may positioned, embedded or included within, or connected to the neck 410 of the vapor plug 106. The electronic thermocouple 702 may be an electronic device or sensor that measures and monitors the temperature within the dewar 104. The electronic thermocouple 702 may wireless transmit and/or communicate with another electronic device, such as a smart data logger, using a wireless protocol. The electronic thermocouple 702 may communicate and provide the temperature to the smart data logger and/or may receive instructions from the smart data logger to monitor the temperature. The smart data logger may display or otherwise communicate the temperature to a user or another electronic platform. This allows for real-time monitoring of the temperature within the dewar 104 by other individuals.

Figure 8A:
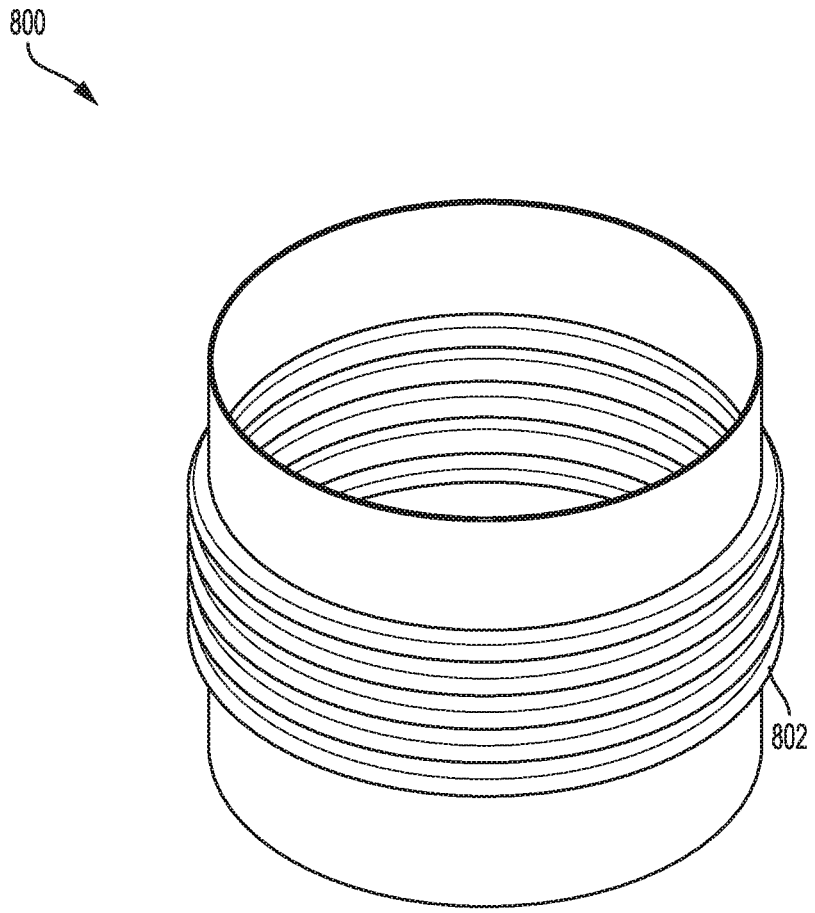
FIG. 8A is an example corrugated neck tube of the cryogenic storage system of FIG. 1 according to an aspect of the invention.
Figure 8B:
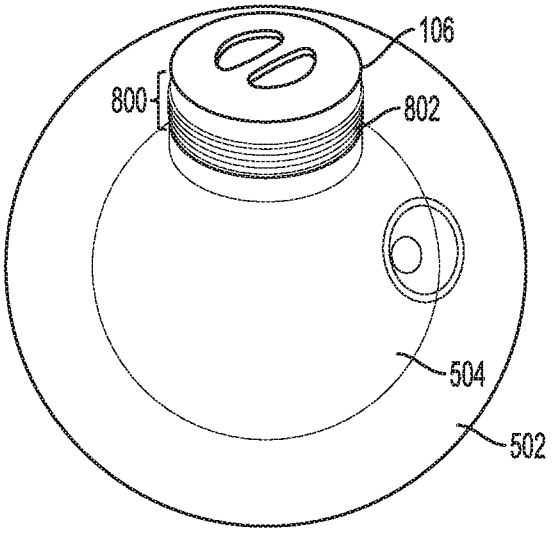
FIG. 8B shows the corrugated neck tube connected to the dewar of the cryogenic storage system of FIG. 1 according to an aspect of the invention.

The storage system 100 may include a corrugated neck tube 800, as shown in FIGS. 8A-8B for example. The corrugated neck tube 800 may be thin-walled. The corrugated neck tube 800 connects the inner wall 504 with the outer wall 502 of the dewar 104. The corrugated neck tube 800 reduces the overall height of the neck tube but keeps the overall length of the path, which conducts the heat, the same as a straight neck tube. The corrugated neck tube 800 may have a serpentine path 802 that provides the heat conduction. By reducing the height of the neck tube but keeping the overall path length the same as a straight neck tube, the corrugated neck tube 800 reduces the overall size of the dewar 104. Moreover, by keeping the overall path length for heat conduction the same as a straight neck tube, the corrugated neck tube 800 reduces the amount of heat that is conducted into the dewar 104. Thus, the corrugated neck tube 800 provides for the same heat conduction with a shorter neck tube (e.g., shorter overall height or size) than a straight neck tube of similar overall path length. For example, the height of the corrugated neck tube 800 may be 2-3 inches long, whereas, the overall path length for heat conduction may be 6 inches long because the overall path length for heat conduction may be a serpentine path along the thin-walled corrugated neck tube.

The storage system 100 includes a ball transfer device 900, as shown in FIG. 9 for example. The ball transfer device 900 may be connected to the enclosure 102 at the inner phalange or wing 202. The ball transfer device 900 may provide an interface between the enclosure 102 and the dewar 104 and allow the dewar 104 to freely rotate within the cavity of the enclosure 102.

The ball transfer device 900 may have a head 902 and a body 904. The head 902 and the body 904 may be shaped as cylinders. The diameter of the head 902 may be greater than the diameter of the body 904. The ball transfer device 900 may be inserted into a hole or opening of the inner phalange or wing 202. For example, the body 904 may be inserted into the opening and the head 902 may form a seal around the opening of the inner phalange or wing 202. The head 902 and body 904 may have an opening and a cavity where a ball bearing 906 and spring 908 reside.

The ball transfer device 900 may have a ball bearing 906, a cup 910 and a spring 908 that sits or rests in a cavity of the ball transfer device 900. The ball bearing 906 may have a top portion and a bottom portion. The top portion of the ball bearing 906 may protrude from the head 902 of the ball transfer device 900. The top portion of the ball bearing 906 that protrudes contacts the dewar 104 when the dewar 104 sits in the cavity of the enclosure 102. The ball bearing 906 minimizes the friction between the enclosure 102 and the dewar 104 allowing the dewar 104 to freely rotate or move within the enclosure 102. The ball bearing 906 provides for a frictionless or a reduced friction surface. The bottom portion of the ball bearing 906 that is within the cavity of the body 904 may rest on the cup 910, which engages with the spring 908.

The cup 910 interfaces between a bottom portion of the ball bearing 906 and the spring 908, such that when a force is applied on the top portion of the ball bearing 906, the bottom portion of the ball bearing 906 presses against the cup 910, which provides a downward force on the spring 908 so that the spring 908 contracts. This allows the dewar 104 to freely rotate within the enclosure 102 and allows the enclosure 102 to absorb shocks and vibrations during storage and/or transport. When the dewar 104 presses against the ball bearing 906, the ball bearing 906 further enters into the cavity of the body 904 while the spring 908 further contracts. This allows the dewar 104 to jostle instead of remain rigid so that any shocks or vibrations are absorbed. When the event causing the shocks or vibrations has passed, the spring 908 returns or expands back into a normal state and keeps the dewar 104 positioned within the cavity of the enclosure 102. Moreover, the one or more ball bearings 906 allow the dewar 104 to rotate or angle so that the dewar 104 remains passively stabilized and upright regardless of the orientation of the enclosure 102.

The spring 908 may contract when a downward force is applied to the ball bearing 906, such as when the dewar 104 exerts an outward force on the ball bearing 906 due to shocks or vibrations on the enclosure 102. For example, when the enclosure 102 is moved, shifted or dropped a vibrational force is exerted on the enclosure 102. If the dewar 104 moves or shifts in response to the vibrational force, the dewar 104 may exert an outward force on the ball transfer device 900, and instead of violently contacting the enclosure 102, the dewar 104 exerts a force on the ball bearing 906, which retracts within the cavity of the body 904 and causes the spring 908 to contract and absorb the force.

Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A spherical dewar for storing a liquid at a temperature below an ambient temperature, comprising:

a top portion;

a bottom portion that weighs more than the top portion and is configured to stabilize the spherical dewar in an upright position when the spherical dewar is tilted, angled or rotated within an enclosure regardless of an orientation of the enclosure;

an inner wall that forms a payload area configured to hold the liquid at the temperature below the ambient temperature;

an outer wall, the outer wall and the inner wall having an opening that allows access to the liquid in the payload area;

a vacuum port that is configured to produce a vacuum insulation between the inner wall and the outer wall;

a vapor plug having a handle, a neck that is inserted into the opening and a locking device that locks the vapor plug in place and maintains a gap between the neck and the inner wall that allows gas to escape; and an electronic thermocouple embedded within the neck of the vapor plug, wherein the locking device includes one or more magnets embedded within an outer periphery of the neck, wherein the one or more magnets embedded within the outer periphery of the neck interlock with one or more other magnets within the inner wall of the spherical dewar, wherein the one or more magnets embedded within the outer periphery of the neck of the vapor plug and the one or more other magnets within the inner wall of the spherical dewar are configured to maintain the gap between the neck of the vapor plug and the inner wall with the vapor plug in a first rotational position, and wherein the one or more magnets embedded within the outer periphery of the neck of the vapor plug and the one or more other magnets within the inner wall of the spherical dewar are configured to maintain the vapor plug in a location at least partially out of the spherical dewar with the vapor plug in a second rotational position different from the first rotational position.

2. The spherical dewar of claim 1, wherein the one or more magnets embedded within the outer periphery of the neck of the vapor plug and the one or more other magnets within the inner wall of the spherical dewar have opposing polarities.

3. The spherical dewar of claim 1, wherein when the neck of the vapor plug is inserted into the opening, the locking device is configured to lock the vapor plug in place and is configured to prevent the vapor plug from falling out when the spherical dewar is oriented or rotated in different directions.

4. The spherical dewar of claim 1, wherein the spherical dewar has a center of gravity or mass within the bottom portion.

5. A spherical dewar for storing a liquid at a temperature below an ambient temperature, comprising:

a top portion;

a bottom portion that weighs more than the top portion and is configured to stabilize the spherical dewar in an upright position when the spherical dewar is tilted, angled or rotated within an enclosure regardless of an orientation of the enclosure;

an inner wall that forms a payload area configured to hold the liquid at the temperature below the ambient temperature;

an outer wall, the outer wall and the inner wall having an opening that allows access to the liquid in the payload area;

a vacuum port that is configured to produce a vacuum insulation between the inner wall and the outer wall;

a vapor plug having a handle, a neck that is inserted into the opening and a locking device that locks the vapor plug in place and maintains a gap between the neck and the inner wall that allows gas to escape; and an electronic thermocouple embedded within the neck of the vapor plug, wherein the neck of the vapor plug has a portion that is corrugated and includes a serpentine path, wherein the serpentine path connects the inner wall with the outer wall.

6. The spherical dewar of claim 5, wherein the neck of the vapor plug has a height that is less than a height of a straight neck tube.

7. A spherical dewar for storing a liquid at a temperature below an ambient temperature, comprising:

a top portion;

a bottom portion that weighs more than the top portion and is configured to stabilize the spherical dewar in an upright position when the spherical dewar is tilted, angled or rotated within an enclosure regardless of an orientation of the enclosure;

an inner wall that forms a payload area configured to hold the liquid at the temperature below the ambient temperature;

an outer wall, the outer wall and the inner wall having an opening that allows access to the liquid in the payload area;

a vacuum port that is configured to produce a vacuum insulation between the inner wall and the outer wall;

a vapor plug having a handle, a neck that is inserted into the opening and a locking device that locks the vapor plug in place, prevents the vapor plug from falling out when the spherical dewar is oriented or rotated in different directions and maintains a gap between the neck and the inner wall that allows gas to escape when the liquid evaporates; and an electronic thermocouple embedded within the neck of the vapor plug, wherein the locking device includes one or more magnets embedded within an outer periphery of the neck, wherein the one or more magnets embedded within the outer periphery of the neck interlock with one or more other magnets within the inner wall of the spherical dewar, wherein the one or more magnets embedded within the outer periphery of the neck of the vapor plug and the one or more other magnets within the inner wall of the spherical dewar are configured to maintain the gap between the neck of the vapor plug and the inner wall with the vapor plug in a first rotational position, and wherein the one or more magnets embedded within the outer periphery of the neck of the vapor plug and the one or more other magnets within the inner wall of the spherical dewar are configured to maintain the vapor plug in a location at least partially out of the spherical dewar with the vapor plug in a second rotational position different from the first rotational position.

8. The spherical dewar of claim 7, wherein the one or more magnets embedded within the outer periphery of the neck of the vapor plug and the one or more other magnets within the inner wall of the spherical dewar have opposing polarities, wherein the opposing polarities are configured to lock the vapor plug in the first rotational position within the spherical dewar and are configured to maintain the vapor plug in the location at least partially out of the spherical dewar with the vapor plug in the second rotational position.

9. The spherical dewar of claim 7, wherein the spherical dewar has a center of gravity or mass within the bottom portion.

10. A spherical dewar for storing a liquid at a temperature below an ambient temperature, comprising:

a top portion;

a bottom portion that weighs more than the top portion and is configured to stabilize the spherical dewar in an upright position when the spherical dewar is tilted, angled or rotated within an enclosure regardless of an orientation of the enclosure;

an inner wall that forms a payload area configured to hold the liquid at the temperature below the ambient temperature;

an outer wall, the outer wall and the inner wall having an opening that allows access to the liquid in the payload area;

a vacuum port that is configured to produce a vacuum insulation between the inner wall and the outer wall;

a vapor plug having a handle, a neck that is inserted into the opening and a locking device that locks the vapor plug in place, prevents the vapor plug from falling out when the spherical dewar is oriented or rotated in different directions and maintains a gap between the neck and the inner wall that allows gas to escape when the liquid evaporates; and an electronic thermocouple embedded within the neck of the vapor plug, wherein the neck of the vapor plug has a portion that is corrugated and includes a serpentine path that connects the inner wall with the outer wall.

11. The spherical dewar of claim 10, wherein the neck of the vapor plug has a height that is less than a height of a straight neck tube.

12. The spherical dewar of claim 10, wherein the vapor plug is removable from the opening.

* * * * *